United States Patent [19]

Hancock

[11] 4,285,488

[45] Aug. 25, 1981

[54] HEIGHT ADJUSTING MECHANISM FOR A SWIVEL CHAIR

[75] Inventor: William L. Hancock, Lexington, Ky.

[73] Assignee: Hoover Universal, Inc., Saline, Mich.

[21] Appl. No.: 22,190

[22] Filed: Mar. 20, 1979

[51] Int. Cl.[3] ..... F16M 11/26

[52] U.S. Cl. ..... 248/405; 411/285; 248/406; 411/291; 411/309; 411/427

[58] Field of Search ..... 248/406, 405; 151/14 R; 85/36

[56] References Cited

U.S. PATENT DOCUMENTS

| | | | |
|---|---|---|---|
| 2,376,167 | 5/1945 | Mitchell | 151/14 R |
| 2,377,168 | 5/1945 | Miller | 151/14 R |
| 2,403,425 | 7/1946 | Bolens | 248/406 X |
| 2,999,665 | 9/1961 | Ericson et al. | 248/405 |
| 3,386,697 | 6/1968 | Helms | 248/406 |
| 3,606,234 | 9/1971 | Prescott | 248/406 |
| 3,870,271 | 3/1975 | Bowman | 248/406 |
| 4,087,070 | 5/1978 | Hancock | 248/406 |

*Primary Examiner*—Francis K. Zugel
*Attorney, Agent, or Firm*—Olsen and Stephenson

[57] ABSTRACT

A swivel chair having a main screw connected to the chair seat and rotatably supported in a mounting assembly on the chair base enabling rotation of the seat relative to the base without varying the height of the seat. Height adjusting apparatus provides for the selective adjustment of the height of the chair seat and includes a nut member threadably mounted on the screw member. The nut member has a thread that is deformed into frictional engagement with the screw thread and when a seating load is applied to the nut member, the magnitude of the frictional resistance of the nut to turning on the screw is increased. As a result, rotation of the chair seat and the screw member will cause the nut member to rotate relative to the mounting assembly and remain fixed relative to the screw member to prevent an unintended varying of the height of the chair seat when it is rotated during use, while still enabling manual intended rotation of the nut when the chair height is to be adjusted.

5 Claims, 6 Drawing Figures

HEIGHT ADJUSTING MECHANISM FOR A SWIVEL CHAIR

BACKGROUND OF THE INVENTION

The present invention relates to an improved height adjusting apparatus for a swivel chair.

Applicant discloses in U.S. Pat. No. 4,087,070, assigned to the assignee of this application, a swivel chair having height adjusting apparatus enabling the use of a non-keywayed screw. However, the nut member and the hand wheel for turning the nut member are integrally formed, thus requiring machining of the hand wheel to form the nut threads. Further, another machining operation is required to form another threaded hole in the hand wheel into which a set screw is positioned for engagement with the chair base to prevent displacement of the screw member from the chair base when the seat is lifted. A hand wheel and nut member with machined threads is costly, both in terms of the materials used and the production effort expended. It is thus the general object of the present invention to provide an improved height adjusting apparatus for a swivel chair which also eliminates the need for a keywayed main screw.

It is the object of the present invention to provide a height adjusting apparatus having novel means for preventing axial displacement of the screw member when the chair seat is lifted.

It is another object of the present invention to provide a height adjusting apparatus for a swivel chair having a detachable hand wheel for turning the nut member on the screw.

SUMMARY OF THE INVENTION

In accordance with the present invention, height adjusting apparatus is provided for a swivel chair having a chair seat supported on a screw member which in turn is rotatably supported in a mounting assembly secured to the chair base. The height adjusting apparatus includes a nut member that is formed from a flat spring steel plate member which exhibits suitable resiliency. The nut member has a main body through which a central opening is formed. A deformable thread extending around the opening is of a thickness less than the groove thickness between adjacent portions of the threads on the screw member. Consequently, the single thread on the nut member forms essentially a single revolution around the screw member when the nut member is threadably mounted on the screw member.

The nut member is split along a line extending from the central opening to the periphery of the nut member so that when the nut member is mounted on the screw member, the portion of the body of the nut member adjacent the split is displaced relative to the portion of the body of the nut member on the other side of the split. The inherent resiliency of the nut member urges the body toward its flat unstressed state. As a result, the thread portions are pressed against the screw member threads to establish at the outset a higher frictional resistance between the nut and screw members than is obtainable with conventional nut and screw members having rigid mating threads. When the nut member is mounted on the screw member and the screw member is positioned in the mounting assembly, a low friction washer is interposed between the nut and the mounting assembly. The resulting slidable movement of the nut member relative to the mounting assembly allows the chair seat to swivel without its height being changed.

The application of a vertical load on the resilient nut member increases the frictional resistance between the nut member and the screw member. The load causes the thread portions to deform further and press harder against the screw member threads. As a result, when the loaded seat is rotated, the nut member remains fixed on the screw member as the frictional resistance between the nut member and the screw member is greater than the frictional resistance between the nut member and the mounting assembly by an increased amount.

A hand wheel having a central opening that is slightly larger than the diameter of the screw member slidably mounts onto the screw member and is positioned adjacent to the nut member. Coacting abutment means on the hand wheel and on the nut member engage enabling rotation of the nut member when the hand wheel is turned. The coacting abutment means includes an integral tang portion on the nut member located at a position diametrically opposed to the location of the split and plurality of upright ribs on the hand wheel which project radially inwardly into interfering relationship with the tang portion. Accordingly, the rotational movement of the hand wheel relative to the screw member is transmitted to the nut member to move the nut member axially on the screw member in order to vary the height of the chair seat. The height adjusting apparatus of this invention thereby enables the hand wheel to be formed of inexpensive material such as plastic since the only load applied to the hand wheel occurs when it is rotated to turn the nut member.

An integral snap-over portion is also formed on the tang so that it snaps over a lip on the mounting assembly. This prevents upward displacement of the screw member from the mounting assembly when the chair seat is lifted.

Further objects, features, and advantages of the present invention will become apparent from a consideration of the following description when taken in connection with the appended claims and the accompanying drawing in which:

Figure 1:
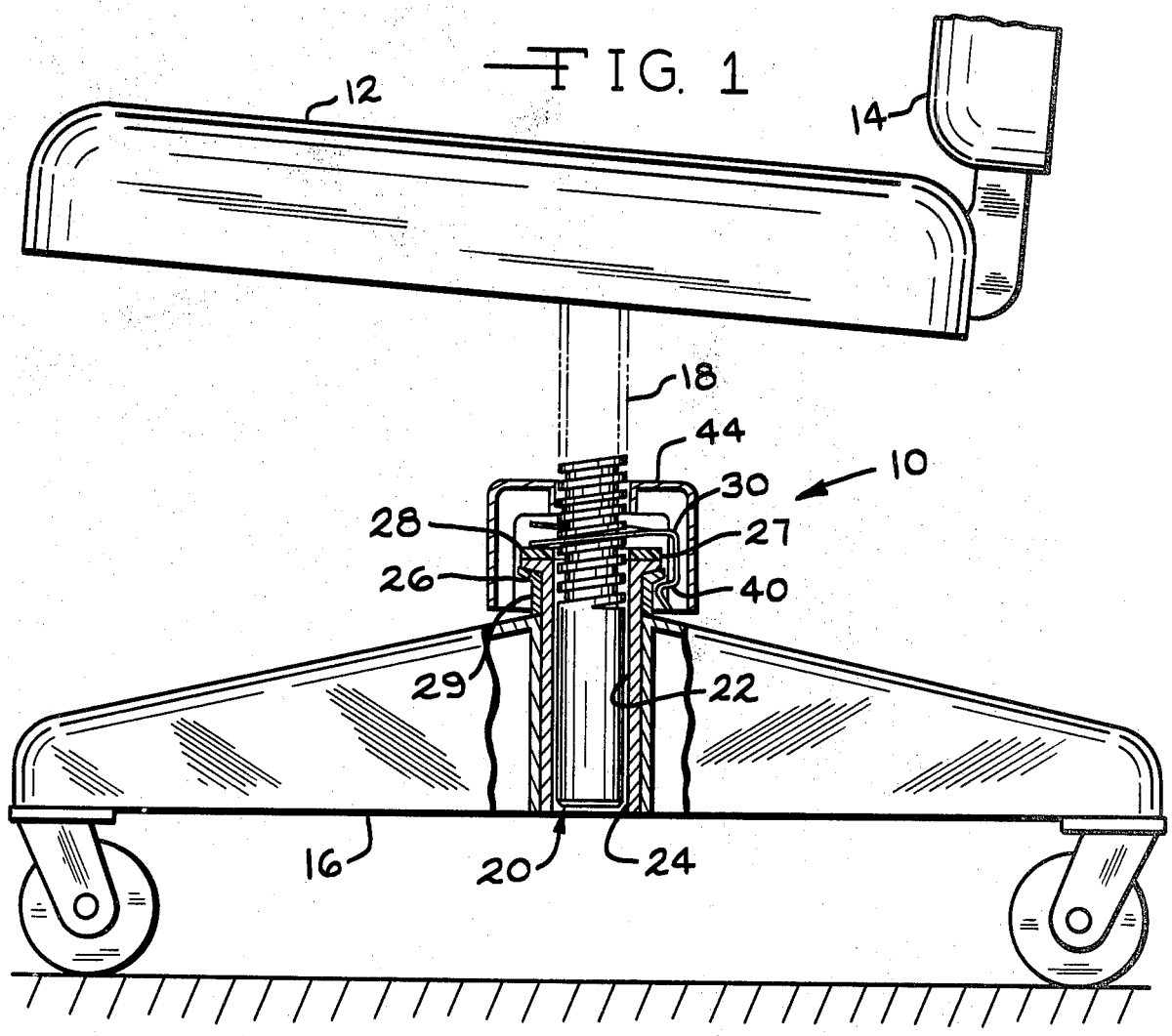
FIG. 1 is a foreshortened side elevational view of a swivel chair equipped with the height adjusting apparatus of this invention, with some parts broken away and other parts shown in section for purposes of clarity.

With reference to the drawing, the swivel chair of this invention, indicated generally at 10, is a conventional office-type chair having a seat 12, a back 14, and a caster-mounted base 16. A main screw 18 is secured to the seat 12 by means of a conventional mounting assembly (not shown) located on the underside of the chair seat 12. The screw member 18 extends downwardly into a main screw-mounting assembly 20 which is carried by the chair base 16. The essential function of the mounting assembly 20 is to maintain the screw 18 in an upright position and to provide a swivel support for the screw 18.

The screw member 18 has a single helical screw thread 19 that defines a single helical groove 21 of a preselected thickness extending around the screw member 18. The preselected thickness of the groove 21, as defined herein, means the axial distance "a" (FIG. 2) between adjacent flights of the thread 19.

The mounting assembly 20 can take a variety of forms and is illustrated as consisting of an upright sleeve 22 which is pressfit into a central opening 24 formed in the base 16. The sleeve 20 has an outwardly extending horizontal flange or lip 26 at its upper end with a flat top surface 27 which forms the top surface of the mounting assembly 20. A washer 28, formed of material having a low coefficient of friction, such as nylon or TEFLON, is mounted on the top surface 27 of the flange 26 concentrically with the sleeve 20 for slidable rotation thereon. A collar 29 supports the upper end of the sleeve 20 on the base 16.

Figure 5:
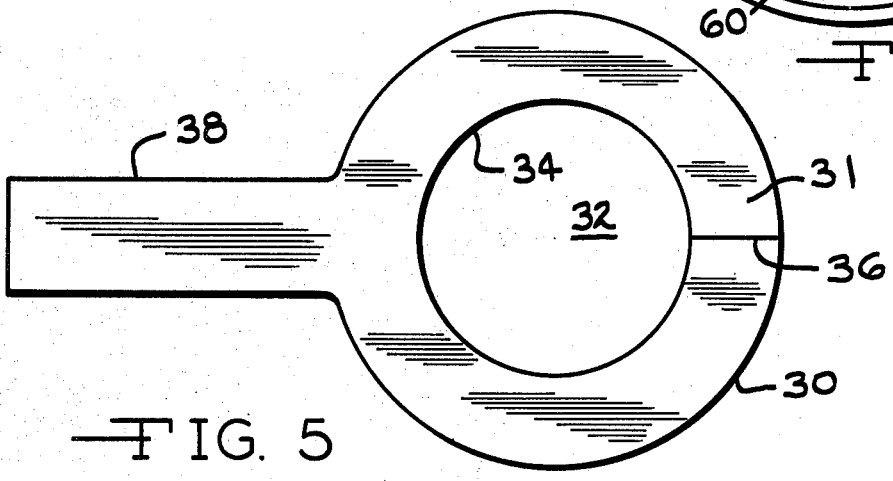
FIG. 5 is a top plan view of a stamping from which the nut member used in the height adjusting apparatus of this invention is formed.

The height adjusting apparatus of this invention includes a resilient nut member 30 which is stamped from a flat blank of spring steel. As seen in FIG. 5, the nut member 30 has a main body 31 through which a central opening 32 is formed. The portions 34 of the body 31 around the opening 32, form a single deformable thread having a thickness less than the thickness "a" of the groove 21 in the screw member 18. The diameter of the opening 32 is also slightly smaller than the outside diameter of the screw member 18 to enable the nut member 30 to be threadably mounted onto the screw member. A parting or split line 36 is formed in the body 31 extending from the central opening 32 radially outwardly to is periphery.

Figure 2:
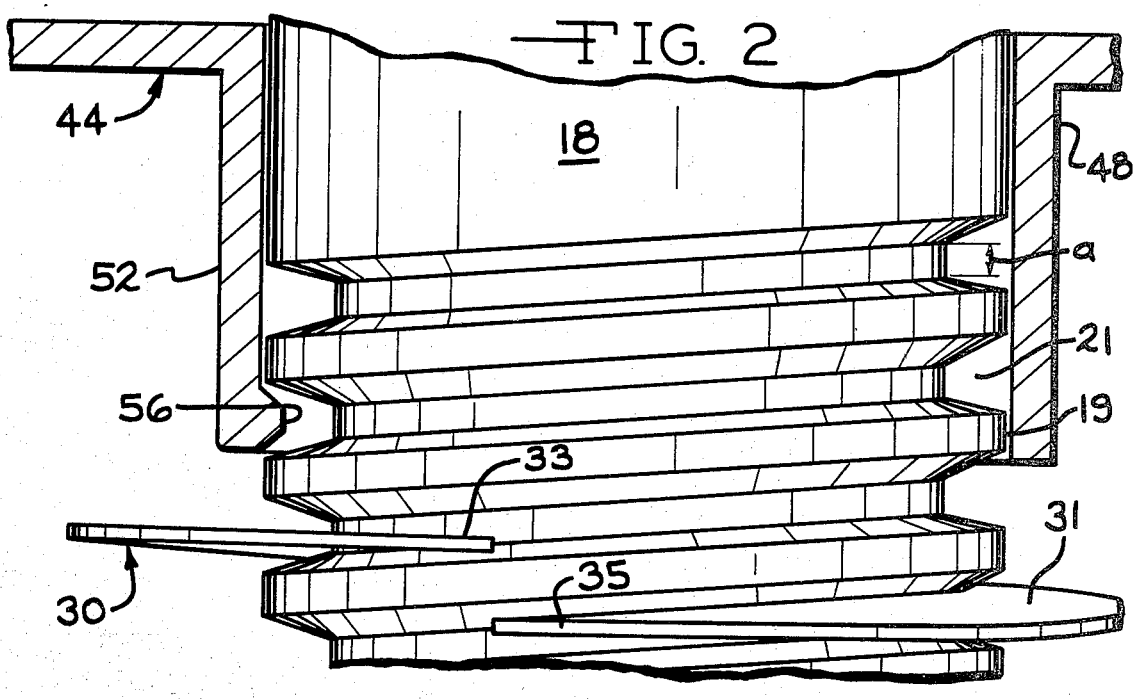
FIG. 2 is an enlarged fragmentary elevational view of the screw member and nut member which form components of the height adjusting apparatus of this invention, along with a portion of the hand wheel employed to turn the nut member.
Figure 3:
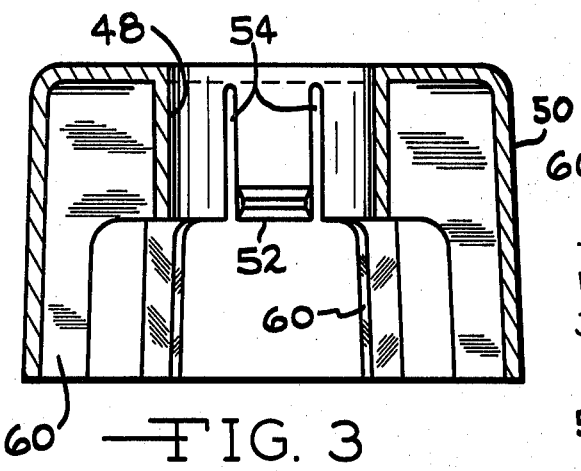
FIG. 3 is a sectional view of the hand wheel of the present invention taken substantially from line 3—3 in FIG. 4.
Figure 4:
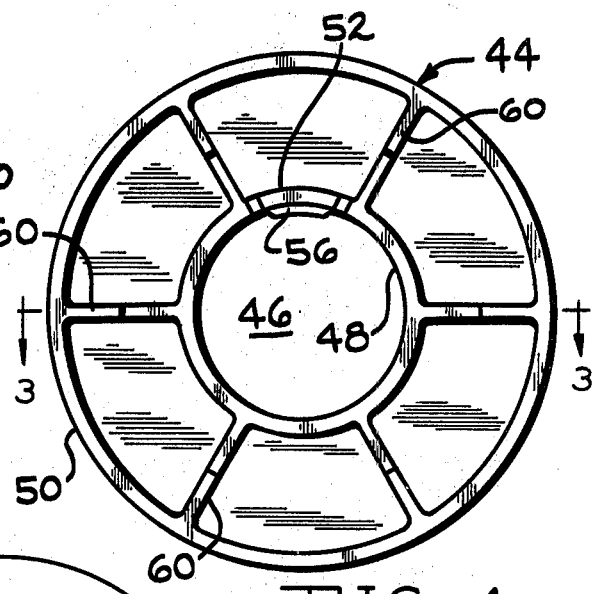
FIG. 4 is a bottom plan view of the hand wheel.

As seen in FIG. 2, when the single thread nut member 30 is threadably mounted on the screw member 18, the thread portion 34 forms a single revolution around the screw member 18 with the thread portion 34 following the helical configuration of the grooves of the screw member 18. The portion 33 of the nut member 30 on one side of the split 36 is displaced axially with respect to the portion 35 of the nut member 30 on the other side of the split 36 so that the thread portion 34 conforms to the thread configuration. As can be seen in FIG. 2, the thread portions 33 and 35 straddle one of the threads on the screw member 18. The inherent resiliency of the spring steel of which the nut member is formed urges the body 31 toward its flat unstressed state. Consequently, the thread portions 33 and 35 are pressed against opposite sides of the screw thread establishing an initial frictional resistance between the nut member 30 and the screw member 18 that inhibits free rotation of the nut member 30 on the screw member 18. A substantial turning force must be applied to the nut 30 to rotate it on the screw 18.

When the seat 12 is occupied, the downwardly directed seating load is transmitted through the screw member 18 to the nut member 30. The deformable thread portions 33 and 35 are thus urged together as the nut member 30 is forced against the washer 28. The thread portions 33 and 35 are pressed against the screw member thread increasing the frictional resistance between the nut member 30 and the screw member 18. The frictional force between the washer 28 and the surface 27 is also increased, but to a lesser extent. As a result, there is even less likelihood of unintentional slippage of nut 30 on screw 18 when the seat 12 is loaded than when empty. Consequently, when the occupied seat 12 is rotated, the nut member 30 remains fixed on the screw member 18 enabling the seat 12 to remain at its established height.

Figure 6:
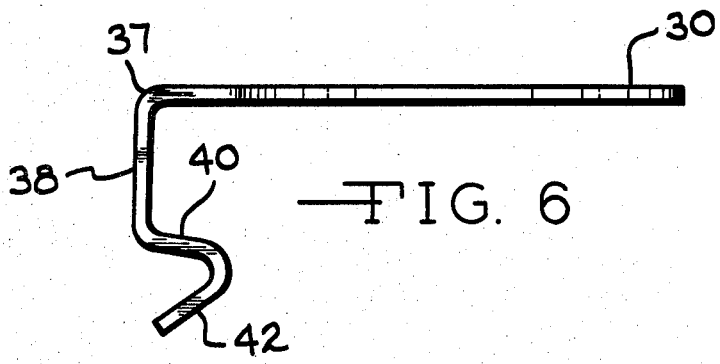
FIG. 6 is a side elevational view of the nut member illustrating the configuration of the tang.

An integrally formed tang 38 is provided on the nut member 30 and extends radially from the body 31 at a position that is diametrically opposed to the location where the split is formed in the body 31. It has been found that locating the split 36 directly opposite the tang 38 provides the nut member 30 with the strongest construction to withstand axial loads. As seen in FIG. 6, the tang 38 is bent at 37 to extend downwardly below the body 31 and has formed at its lower end a snap-over portion 40 that extends radially inwardly toward the nut member 30 and terminates in a downwardly and outwardly inclined portion 42. The portion 40 is positionable below the flange 26, as seen in FIG. 1, in interfering relationship with the flange 26. The inclined portion 42 at the lowermost end of the tang 38 facilitates the mounting of the nut member 30 on the mounting assembly 20. When the nut member 30, which is mounted on the screw member 18, is forced against the flange 26, the inclined portion 42 rides downwardly over the flange 26 to a position below the lip 26. The inherent resiliency of the tang 38 causes it to return to its normal upright position when the stop portion 40 is located below the flange 26. When the seat 12 is lifted, the flange 26 will be engaged by the stop portion 40 so that the screw member 18 will remain in the mounting assembly when the seat 12 is lifted.

A hand wheel 44, preferably formed of inexpensive material such as plastic, has a central opening 46, the diameter of which is slightly larger than the outside diameter of the screw member 18. The larger diameter of the central opening 46 enables the hand wheel 44 to be slidable and rotatable on the screw member 18. The hand wheel 44 has an inner skirt 48 that defines the central opening 46 and an outer skirt 50 that overlies the nut member 30 and the flange 26 of the mounting assembly 20 when the hand wheel 44 is positioned adjacent to the nut member 30 to conceal these components. A flap member 52 is formed in the inner skirt 48 by a pair of parallel slots 54 and carries an inwardly projecting shoulder 56. The shoulder 56 is resiliently urged into the grooves on the screw member 18 to inhibit the axial displacement of the hand wheel 44.

A plurality of radially and inwardly projecting rib members 60 are formed integrally with the outer skirt 50 at selected circumferentially spaced-apart positions. The rib members 60 and the tang 38 on the nut member 30 form coacting abutment means so that when the hand wheel 44 is positioned adjacent the nut member 30, the rib members 60 and the tang 38 are positioned in an interfering relationship with each other. Consequently, the hand wheel 44 is prevented from being rotated relative to the nut member 30 so that rotation of the hand wheel 44 relative to the screw member 18 is transmitted to the nut member 30. During normal use of the chair 10, any rotation of the screw 18 in response to normal rotation of the seat 12 will cause the nut member 30 to rotate relative to the flange 26. The nut member 30 will remain fixed on the screw member 18 by virture of the higher frictional resistance between the nut member 30 and the screw member 18 relative to the frictional resistance between the nut member 30 and the mounting assembly 20. Thus, during normal swivelling, the height of the chair seat 12 will remain constant.

When it is desired to change the vertical position of the seat 12 with respect to the base 16, all that is required is rotation of the hand wheel 44 relative to the nut member 18, accomplished by grasping the hand wheel 44 and turning it in the desired direction. This relative rotation is transmitted to the nut member 30 which is thus moved axially on the screw member 18. The axial movement of the nut member 30 relative to the screw member 18 thereby varies the height of the chair seat 12.

From the above description, it can be seen that an improved height adjusting apparatus for a swivel chair is provided characterized by its simple construction and use of inexpensive components. The use of the nut member 30 with the deformable thread in tight frictional engagement with the screw thread greatly simplifies the apparatus. From a functional standpoint, the hand wheel 44 could be eliminated, although it is considered desirable from the standpoint of aesthetics, or the hand wheel and nut could also be formed as a single unit having a deformable thread.

Employment of a nut member equipped with the integral tang and snap-over portion greatly reduces manufacturing costs since it eliminates the requirement for a tapped hole in the hand wheel 44. It should also be pointed out that, if desired, the hand wheel 44 could be provided with the snap-over portion instead of the nut 30. Use of the nut member 30 with the deformable thread portions 33 and 35 enhances the ability of the height adjusting mechanism 10 to maintain its established setting when the chair is swivelled. The hand wheel 44 can be formed of inexpensive material since it encounters only minor loads when it is rotated to rotate the nut member 30. The height adjusting mechanism 10 is reliable, durable and compact to allow an attractive swivel chair to be constructed.

What is claimed:

1. Height adjusting apparatus for a swivel chair comprising a main screw member having thread means formed thereon, a nut member having a body portion which is a generally flat piece of steel deformed into engagement with said screw thread so that said nut member is threadably mounted on said screw member for selective movement lengthwise thereof to adjusted positions in response to relative rotation between said nut member and said screw member, said body portion being continuously biased against said thread means in a direction axially of said screw member to impart an initial frictional resistance between said nut member and said screw member hindering rotation therebetween, said body portion being operable to deform against said screw member thread means in response to the application of a load to said nut member in a direction generally lengthwise of said screw member thereby increasing the frictional resistance between said nut member and said screw member to restrain relative movement between said nut member and said screw member.

2. Height adjusting apparatus according to claim 1 wherein and body portion has an opening formed therethrough, said thread means comprising portions of said body portion defining said opening, and a parting line formed through said body portion extending between said opening and the periphery of said body portion so that when said nut member is threadably mounted on said screw member one portion of said body portion adjacent one side of said parting line is displaced axially of the portion of said body portion adjacent the other side of said parting line with said adjacent portions straddling said screw thread means, the resiliency of said body portion urging said adjacent portions toward each other and into engagement with said screw thread means to impart said initial frictional resistance between said nut member and said screw member, said adjacent portions being further pressed against said screw thread means in response to said load applied to said nut member to increase the frictional resistance between said nut member and said screw member and thereby restrain relative movement between said nut member and said screw member when said screw member is rotated under load.

3. The height adjusting apparatus according to claim 1, further including a hand wheel comprising an annular body with a central unthreaded opening larger than the diameter of the main screw member and having said screw member extending therethrough, and coacting means on said nut member and on said hand wheel for transmitting rotational movement of said hand wheel relative to said screw member to said nut member to vary the lengthwise position of said nut member on said screw member.

4. Height adjusting apparatus for a swivel chair having a seat member and a supporting base for said seat member, a main screw member secured to and extending downwardly from said seat member, a main screw mounting assembly located on said supporting base and including an upright tubular member terminating at its upper end in a radially extending lip, said screw member extending downwardly into said tubular member, a nut member threadably mounted on said screw member at a position above and in contact with said mounting assembly to support said screw member on said mounting assembly so that rotation of said seat member and said screw member causes identical rotation of said nut member, said nut member being manually rotatable on said screw member to adjusted positions lengthwise of said screw member to adjust the height of said swivel chair, and yieldable snap means forming an integral extension of said nut member, said snap means being forced over said lip and into an interfering relationship therewith in response to movement of said nut member toward said mounting assembly so that a subsequent lifting of said seat member and said screw member will cause said base to be concurrently lifted as said snap means engages said lip, said nut member being formed from a flat plate member having a circular opening forming a nut thread, said main screw extending through said opening and said plate member being deformed so that said nut thread is continuously frictionally biased against said screw thread, said integral extension of said nut member terminating in a generally horizontal stop portion and an inclined riding portion extending downwardly from said stop portion, said inclined riding portion engaging said lip as said nut member is moved toward said mounting assembly to move said horizontal portion over said lip.

5. In height adjusting apparatus for a swivel chair, a main screw member of preselected diameter having a helical thread formed thereon, and a resilient nut member thread mounted on said screw member for selective movement lengthwise thereof to adjusted positions in response to relative rotation between said nut member and said screw member, said nut member being continuously biased against said helical thread in a direction axially of said screw member to impart a frictional resistance between said nut member and said screw member hindering rotation therebetween, said nut member comprising a generally flat plate member having a central opening through which said screw member extends, said plate member being split along a line extending from said opening radially outwardly to the periphery of said plate member and being deformed so that the plate member around said opening straddles and frictionally grips a portion of the thread to restrain relative rotation of the nut member relative to the screw member.

* * * * *